US012799632B2

(12) United States Patent
He et al.

(10) Patent No.: US 12,799,632 B2
(45) Date of Patent: Nov. 17, 2026

(54) SPINNING SOLUTION, HEAT-RESISTANT CREEP-RESISTANT FIBER AND PREPARATION METHOD THEREFOR

(71) Applicants: DONGHUA UNIVERSITY, Shanghai (CN); JIANGSU LIU JIA TECHNOLOGY COMPANY LTD., Yancheng (CN)

(72) Inventors: Yong He, Shanghai (CN); Zixian Guo, Yancheng (CN); Jungu Guo, Yancheng (CN); Yadong Guo, Shanghai (CN); Xinpeng Wang, Yancheng (CN); Chaoyang Xiang, Yancheng (CN); Yimin Wang, Shanghai (CN); Jianhua Ni, Shanghai (CN)

(73) Assignee: JIANGSU HOLY CRANE SCIENCE AND TECHNOLOGY DEVELOPMENT CO., LTD, Yancheng (CN)

( * ) Notice: Subject to any disclaimer, the term of this patent is extended or adjusted under 35 U.S.C. 154(b) by 673 days.

(21) Appl. No.: 18/273,037

(22) PCT Filed: Aug. 27, 2021

(86) PCT No.: PCT/CN2021/114899
§ 371 (c)(1),
(2) Date: Jul. 19, 2023

(87) PCT Pub. No.: WO2022/156215
PCT Pub. Date: Jul. 28, 2022

(65) Prior Publication Data

US 2024/0102204 A1 Mar. 28, 2024

(30) Foreign Application Priority Data

Jan. 20, 2021 (CN) ..... 202110074594.0

(51) Int. Cl.

| | |
|---|---|
| ***C08F 2/46*** | (2006.01) |
| ***C08F 2/50*** | (2006.01) |
| ***C08G 61/04*** | (2006.01) |
| ***D01D 5/06*** | (2006.01) |
| *D06M 101/20* | (2006.01) |

(52) U.S. Cl.
CPC ..... *D01D 5/06* (2013.01); *D06M 2101/20* (2013.01); *D06M 2200/30* (2013.01)

(58) Field of Classification Search
CPC ..... D01D 5/06; D01D 5/04; D01D 10/00; D06M 10/001; D06M 2200/30; D01F 1/10; D01F 6/46; C08F 2/50; C08F 2/48; C08F 212/16; C08F 212/08; C08F 220/1804; C08F 220/301; C08F 220/1818; C08F 220/06; Y02P 70/62; Y02P 20/54
USPC ..... 522/161, 157, 150, 1, 6, 71, 189, 184; 520/1
See application file for complete search history.

(56) References Cited

FOREIGN PATENT DOCUMENTS

| | | | | | |
|---|---|---|---|---|---|
| CN | 1431358 | A | | 7/2003 | |
| CN | 101538793 | A | | 9/2009 | |
| CN | 102493168 | A | | 6/2012 | |
| CN | 102965748 | A | | 3/2013 | |
| CN | 103741247 | A | | 4/2014 | |
| CN | 104695038 | A | * | 6/2015 | |
| CN | 104695039 | A | | 6/2015 | |
| CN | 104711696 | A | | 6/2015 | |
| CN | 104818541 | A | | 8/2015 | |
| CN | 105063787 | A | | 11/2015 | |
| CN | 106676879 | A | | 5/2017 | |
| CN | 109234850 | A | | 1/2019 | |
| CN | 109251389 | A | | 1/2019 | |
| CN | 110922515 | A | | 3/2020 | |
| CN | 112796000 | B | * | 11/2021 | ..... C08J 5/18 |
| JP | H02175913 | A | | 7/1990 | |

(Continued)

OTHER PUBLICATIONS

Qu et al, Photocross-linking of Low-Density polyethylene. I. Kinetics and Reaction Parameters, 1993, Journal of AppliedPolymer Science, vol. 48, 701-709 (Year: 1993).*

(Continued)

*Primary Examiner* — Jessica Whiteley
(74) *Attorney, Agent, or Firm* — Bayramoglu Law Offices LLC

(57) ABSTRACT

A spinning solution, a heat-resistant creep-resistant fiber and preparation method therefor are provided. The spinning solution includes a polyethylene, a solvent and a photoinitiator, and the content of the photoinitiator is 0.2 wt %-10 wt % of the mass of the polyethylene; gel-spinning and multi-stage drafting the spinning solution; then performing ultraviolet irradiation by an ultraviolet light source to obtain a heat-resistant creep-resistant polyethylene fiber; the light intensity and the time of the ultraviolet light source is 100 $W/cm^2$-5000 $W/cm^2$ and 10 s-600 s, respectively; the gel content and the crystallinity of the heat-resistant creep-resistant polyethylene fiber is 20 wt %-100 wt % and 50 wt %-90 wt %, respectively; the creep rate of the fiber is $10^{-8}$ $s^{-1}$-$10^{-7}$ $s^{-1}$ under conditions of a temperature of 70° C. and a load of 300 MPa; the fracture temperature of the fiber is 155° C.-245° C. under conditions of a load of 15 MPa and a heating rate of 2° C./min.

15 Claims, 1 Drawing Sheet

(56) References Cited

FOREIGN PATENT DOCUMENTS

| | | | |
|---|---|---|---|
| JP | H02175914 | A | 7/1990 |
| WO | 2009043598 | A2 | 4/2009 |

OTHER PUBLICATIONS

Dong et al, CN 112796000 Machinet Translation, Nov. 19, 2021 (Year: 2021).*
Guo et al, CN 104695038 Machine Translation, Jun. 10, 2015 (Year: 2015).*
Chin et al, Macromolecular photoinitiators enhance the hydrophilicity and lubricity of natural rubber, 2016, J. Appl. Polym. Sci., 43930 (Year: 2016).*
Li Shujun, et al., Effect of Electron Beam Radiation on the Structure and Mechanical Properties of Ultra High Molecular Weight Polyethylene Fibers, J. Radiat. Res. Radiat. Proces., 1998, pp. 135-140, vol. 16, No. 3.
GB/T 19975-2005, Test method of tensile properties for high tenacity filament yarn, National Standard of the People's Republic of China, 2005, pp. 1-6.

* cited by examiner

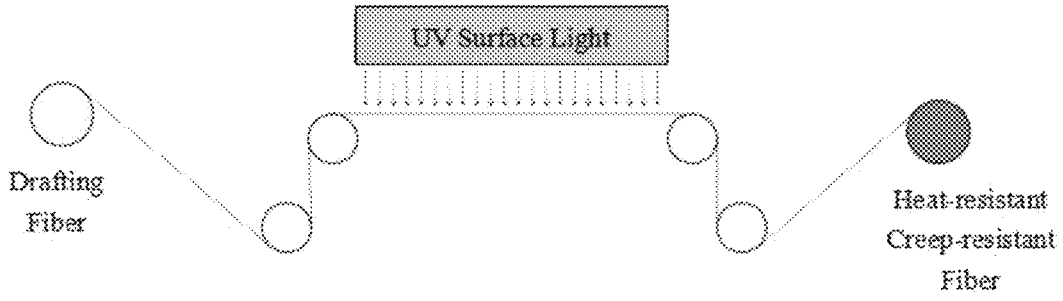
UV Surface Light
Drafting Fiber
Heat-resistant Creep-resistant Fiber

SPINNING SOLUTION, HEAT-RESISTANT CREEP-RESISTANT FIBER AND PREPARATION METHOD THEREFOR

CROSS REFERENCE TO THE RELATED APPLICATIONS

This application is the national phase entry of International Application No. PCT/CN2021/114899, filed on Aug. 27, 2021, which is based upon and claims priority to Chinese Patent Application No. 202110074594.0, filed on Jan. 20, 2021, the entire contents of which are incorporated herein by reference.

TECHNICAL FIELD

The present invention belongs to the technical field of chemical fibers, and more particularly, relates to a spinning solution, heat-resistant creep-resistant fiber and preparation method therefor.

BACKGROUND

Ultra-high molecular weight polyethylene (UHMWPE) fibers are currently fibers with highest specific strength and specific modulus in the world, and are spun by polyethylene with a molecular weight of more than one million. The production of the fiber mainly has two different production process technology routes: one is dry gel spinning process route using a high-volatility solvent (decahydronaphthalene, toluene, etc.), referred to as a dry route; the other is wet gel spinning process route using a high-volatility solvent (mineral oil, white oil, etc.), referred to as a wet route. The UHMWPE fiber has good impact resistance and large specific energy absorption, which can be made into bulletproof vests, bulletproof helmets, bulletproof plates (such as armored plates for helicopters, tanks and ships), stab-proof vests, radar protective shell covers, a missile covers, etc. in the military.

However, the polymer chain in the UHMWPE fiber is simple planar sawtooth structure, and no hydrogen bond between molecules, the Van der Waals force between molecules only has a dispersion force, the intermolecular force is small, resulting in poor heat resistance and easy creep of the UHMWPE fiber, which determines that the service life of related products of conventional UHMWPE fibers (bulletproof helmets, bulletproof vests, ropes and cables, etc.) is short (3-5 years), resulting in high cost of use, and severely restricting the expansion of its application. Therefore, the research on heat resistant and creep resistant of UHMWPE fibers becomes a difficulty and hot research point in the field.

WO2009043598 improves the creep resistance by two orders of magnitude by accurately introducing trace branched chains into the UHMWPE polymer chain, and develops a creep-resistance fiber that can be used to permanently fix the anchor rope, but its heat resistance is not substantially improved. Chinese patent CN200910097866 pre-treats the UHMWPE fiber through supercritical carbon dioxide assisted infiltration dissolved in photosensitizer, and then performs ultraviolet irradiation to cross-link the internal molecular chains of the UHMWPE fibers, thus improving its creep resistance. CN201510096055 and CN201510096511 swell ultra-high molecular weight polyethylene powder with a solvent to form pores, then add a cross-linking agent, a curing agent, an initiator, etc., and perform gel spinning and irradiation cross-linking to obtain a heat-resistant antistatic UHMWPE fiber. In the prior art, the UHMWPE fiber is soaked in an organic solution composed of a photosensitizer and a cross-linking agent, and then the fiber is cross-linked by ultraviolet irradiation. CN201510267463 adds an allyl cross-linking agent, a free radical scavenger, an initiator, etc., to an ultra-high molecular weight polyethylene gel, and performs spinning and irradiation to prepare a cross-linked UHMWPE fiber. CN201810883121 initiates cross-linking of the UHMWPE fiber precursor containing VPOSS at the last-stage heat drafting treatment to obtain a cross-linked modified UHMWPE fiber. CN201110434278 prepares a cross-linked modified UHMWPE fiber by immersing the UHMWPE fiber in a cross-linking solution and then performing ultraviolet irradiation. CN201611262380 irradiates the surface-coated radial-sensitive agent to prepare a surface cross-linked UHMWPE fiber. The literature (*Journal of Radiation Research and Radiation Processing,* 1998(03):7-12) reported a method for preparing a cross-linked UHMWPE fiber by high-energy radiation. These methods mainly have complex procedures, low efficiency, uneven cross-linking, unstable quality, and excessive preparation costs. Or the degree of cross-linking is insufficient, and the performance improvement is limited; or a cross-linking agent needs to be added, and these cross-linking agents tend to cross-link during fiber processing leading to unstable spinning, which are difficult for large-scale production. For example, the photoinitiator and cross-linking agent immersion method suffers from long immersion time, large temperature influence, uneven distribution of photoinitiator and cross-linking agent, which eventually leads to unstable product quality and low production efficiency, and thus is not suitable for large-scale production.

SUMMARY

In order to solve the problems of easy creep, poor dimensional stability and poor heat resistance of polyethylene fibers in the prior art, the present invention provides a spinning solution, heat-resistant creep-resistant fiber and preparation method therefor; the first purpose of the present invention is to provide a polyethylene spinning solution; the second purpose is to provide a high-performance polyethylene fiber with both high gel content and high crystallinity, which is excellent in creep resistance and heat resistance; the third purpose is to provide a low-cost and high-efficient preparation method suitable for large-scale and continuous production of the fiber.

A polyethylene spinning solution, including a polyethylene and a solvent, also including a photoinitiator, wherein a content of the photoinitiator is 0.2 wt %-10 wt % of a mass of the polyethylene; more preferably 0.5 wt %-8 wt %, most preferably 1 wt %-5 wt %, if it is too low, it will be incapable of providing a high degree of cross-linking, and if it is too high, it will be easy to color and affect the mechanical properties of the fiber;

wherein the photoinitiator is one or more selected from the group consisting of a photoinitiator I, a photoinitiator II, and a photoinitiator III;

wherein a structural formula of the photoinitiator I is

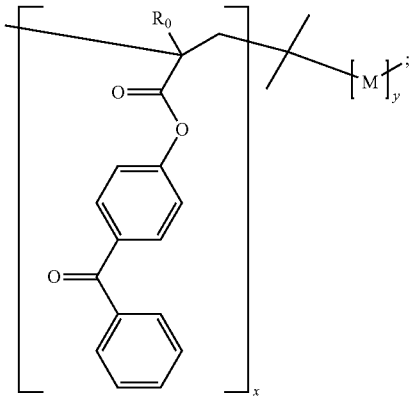

wherein $R_0$ is a hydrogen atom, hydrocarbyl of C1-C10, or halogen, but considering the availability of raw materials, the hydrogen atom or the methyl is preferred; wherein M is a styrene unit, an acrylic acid unit, a methacrylic acid unit, a styrene derivative unit, an acrylic acid derivative unit, or a methacrylic acid derivative unit; wherein the value of x is an integer of 2-1000, and the value of y is an integer of 0-2000;

wherein a structural formula of the photoinitiator II is

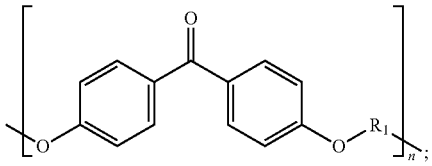

wherein n is an integer greater than or equal to 2; wherein $R_1$ is alkylene of C1-C20 or

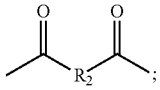

wherein $R_2$ is alkylene of C1-C18;

wherein a structural formula of the photoinitiator III is

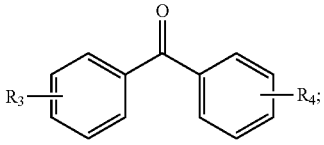

wherein $R_3$ is halogen, alkoxy, saturated hydrocarbyl, aryl or hydroxyl, and $R_4$ is halogen, alkoxy, saturated hydrocarbyl, aryl or hydroxyl.

The preparation method of the said photoinitiator II is as follows.

When $R_1$ is alkylene of C1-C20, the method is: adding 4,4'-dihydroxybenzophenone, dihalogenated hydrocarbon and an inorganic base to the solvent, and performing polycondensation reaction at atmospheric pressure with solvent reflux under an inert atmosphere; the temperature of the polycondensation reaction is the temperature of the solvent reflux, and the time is 4-24 h; the molar ratio of the 4,4'-dihydroxybenzophenone to the dihalogenated hydrocarbon is (0.95-1.05):1; the molar ratio of the inorganic base to the dihalogenated hydrocarbon is (2-4):1; the ratio of the mole number of the 4,4'-dihydroxybenzophenone to the volume of the solvent is (1-5) mol: 1 L; the dihalogenated hydrocarbon is alkylene dibromide of C1-C20, the inorganic base is potassium carbonate, sodium carbonate, or sodium bicarbonate, and the solvent is acetone, propanol, butanol, ethyl acetate, toluene, or xylene.

When $R_1$ is

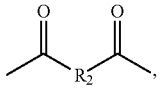

the method is:

(1) acetylation: adding catalyst I and excess acetic anhydride to 4,4'-dihydroxybenzophenone, heating to 140-160° C. for 2-5 h, then filtering, washing and drying to obtain 4,4'-acetoxybenzophenone;

in acetylation, the molar ratio of 4,4'-dihydroxybenzophenone, catalyst I and acetic anhydride is 1:(0.01-0.10):(2-4), and catalyst I is concentrated sulfuric acid, p-toluenesulfonic acid or methanesulfonic acid;

(2) melt polycondensation reaction: adding diacid and catalyst II to 4,4'-acetoxybenzophenone, replacing with inert atmosphere for 2-3 times and gradually heating up to 210-250° C. within 1-2 h under the inert atmosphere, then polymerizing under vacuum condition for 1-8 h;

the molar ratio of 4,4'-acetoxybenzophenone to diacid in the melt polycondensation reaction is (0.95-1.05):1, and the addition amount of catalyst II is 0.1-2.0 wt % of the total mass of 4,4'-acetoxybenzophenone and diacid; catalyst II is zinc acetate, magnesium acetate, stannous acetate, antimony oxide, or tetrabutyl titanate, and the diacid is terephthalic acid, 1,4-cyclohexanedicarboxylic acid, or alkyl diacid of C1-C20.

The following preferred technology program is presented to give a detailed description for this invention:

The said polyethylene spinning solution, wherein a number average molecular weight of the photoinitiator I is 1.05 k-100 k, $R_0$ is the hydrogen atom or methyl, x/(x+y) is 0.05-1;

in the structural formula of photoinitiator II, wherein the alkylene is saturated alkylene or arylene, and its thermal decomposition temperature is ≥250° C. The thermal decomposition temperature of the photoinitiator in the prior art is basically lower than 250° C., that is lower than the gel spinning temperature of the general polyethylene (~290° C.), so that the commonly used photoinitiators are not suitable to be added to the spinning solution due to volatilization during spinning and thermal decomposition failure;

in the structural formula of the photoinitiator II, wherein the alkylene is saturated alkylene or arylene, a number average molecular weight of the photoinitiator II is 1.2 k-100 k, and a molecular weight distribution is 1.3-1.8;

in the structural formula of the photoinitiator III, $R_3$ and $R_4$ are halogen, alkoxy, saturated hydrocarbyl, aryl, or hydroxyl at the same time.

The said polyethylene spinning solution, in the spinning solution, wherein a mass ratio of the polyethylene to the solvent is (5:95)-(30:70), a molecular weight of the polyethylene is 0.3 million-10 million (preferably 1 million-10 million), and the solvent is one or more selected from the group consisting of tetrahydronaphthalene, decahydronaphthalene, n-heptane, n-hexane, cyclohexane, paraffin oil, white oil, mineral oil, vegetable oil, animal oil, kerosene, hydrocarbon solvent and xylene solvent. In consideration of availability and operability, the solvent is preferably one or more selected from the group consisting of white oil, xylene or decahydronaphthalene.

The said polyethylene spinning solution, wherein the spinning solution also includes an alkynyl compound; the alkynyl compound and the photoinitiator in the present invention can exert a multiplication effect together, and the addition of the alkynyl compound can significantly accelerate the cross-linking speed of the polyethylene, and improve the cross-linking degree of the polyethylene. In the spinning solution, a content of the alkynyl compound is 0.1 wt %-5.0 wt % of the mass of the polyethylene; wherein the alkynyl compound is one or more selected from the group consisting of 1,4-diphenylbutanediyne, 4-phenylalkynylphthalic anhydride, 4,4'-diethynylbiphenyl, 1,3,5-triynylbenzene, 1,3-dialkynylbenzene and 1,4-dialkynylbenzene.

The said polyethylene spinning solution, wherein the spinning solution also includes various auxiliary agents such as antioxidants, pigments, or/and dyes on the premise of not affecting the effect of the invention. The antioxidant is selected from tocopherol, vitamin E, butylated hydroxytoluene, bis(2,4-di-tert-butylphenol) pentaerythritol diphosphite and tris(2,4-di-tert-butylphenyl) phosphite and so on. The invention is not particularly limited to dyes and pigments. The dye can be disperse red FB, disperse orange S-4RL, disperse violet HFRL, disperse blue CR-E, disperse yellow A-G, disperse green C-6B and so on. The pigments can be inorganic pigments, such as oxides, chromates, sulfates, carbonates, silicates, borates, molybdates, phosphates, azo pigments, phthalocyanine pigments, anthraquinones, indigos, quinacridones, etc.

The preparation method of the polyethylene spinning solution is not limited in the invention. Generally, one or more of tetrahydronaphthalene, decahydronaphthalene, n-heptane, n-hexane, cyclohexane, paraffin oil, white oil, mineral oil, vegetable oil, animal oil, kerosene, hydrocarbon solvent and xylene are used as the solvent, adding the photoinitiator, adding various auxiliary agents (e.g., cross-linking agents, antioxidants, pigments or/and dyes, etc.) or not, adding polyethylene powder, and stirring and swelling under the condition of heating or not heating to obtain the spinning solution.

A method for preparing a heat-resistant creep-resistant polyethylene fiber by the said polyethylene spinning solution, comprising the following steps:

(1) gel-spinning and multi-stage drafting the polyethylene spinning solution to obtain a polyethylene fiber; the specific gel spinning process is not particularly limited, which can be either a dry gel spinning or a wet gel spinning process;

(2) performing ultraviolet irradiation on the surface of the polyethylene fiber obtained in step (1) by an ultraviolet light source to obtain the heat-resistant creep-resistant polyethylene fiber; wherein the light intensity of the ultraviolet light source is 100 W/cm$^2$-5000 W/cm$^2$ (the intensity of ultraviolet light where the fiber is ultraviolet irradiated), and the time of ultraviolet irradiation is 10 s-600 s.

The present invention does not limit the gel spinning process, the existing process can be used. The spinning solution is dissolved and extruded by twin-screw, quantitatively sprayed by a metering pump and a spinneret, and then subjected to dry or wet forming and multi-stage drafting to obtain the polyethylene fiber. The temperature of twin-screw needs to be set according to the solvent, for example, when decahydronaphthalene is used as the solvent, it can be set to about 180° C.; when white oil is used, it can be up to 290° C.

In the prior art, in view of the existence of oxygen inhibition effect during the ultraviolet curing process, and the specific surface area of the fiber is much larger than that of coatings, inks, etc., it is generally considered that it is difficult to prepare polyethylene fibers with high gel content only by photocuring in an air atmosphere. However, it is unexpected that in the present invention, when using a suitable ultraviolet light source, a suitable photoinitiator, optimizing the photo-crosslinking process, under the condition of not adding cross-linking agent, a cross-linked polyethylene fiber with a high gel content can be continuously prepared in an air atmosphere by ultraviolet irradiation. Considering that if the light intensity is too low, the required irradiation time will be too long to affect the production efficiency, and if the light intensity is too strong, it will easily lead to the breakage of the polyethylene polymer main chain and other side reactions, so that the ultraviolet light intensity at the fiber is preferably 100 W/cm$^2$-5000 W/cm$^2$, more preferably 200 W/cm$^2$-3000 W/cm$^2$, and most preferably 500 W/cm$^2$-2000 W/cm$^2$.

The said method for preparing a heat-resistant creep-resistant polyethylene fiber, wherein the multi-stage draft is a three-stage draft: a first-stage draft ratio is 2-8 times; a second-stage draft ratio is 1-2 times; a third-stage draft ratio is 1-2 times; a drafting temperature is 90-150° C.;

wherein the wavelength of the ultraviolet light is 270 nm-400 nm. There is no special limitation on the ultraviolet light source, in consideration of energy saving, high light intensity and long service life, the ultraviolet LED surface light source is preferred; there is no special limitation on the wavelength of ultraviolet light, in consideration of the cost of the light source, safety and availability, generally between 270-400 nm is good.

A heat-resistant creep-resistant polyethylene fiber prepared by the said method, wherein the fiber has a gel content of 20 wt %-100 wt %, and a crystallinity of 50 wt/6-90 wt %. When the gel content in the fiber is greater than 20 wt %, its creep resistance, dimensional stability and heat resistance can be significantly improved. The high gel content is beneficial to further improving heat resistance, dimensional stability and strength retention. Due to high gel content and high crystallinity, the polyethylene fiber is endowed with excellent creep resistance, heat resistance and dimensional stability.

The said heat-resistant creep-resistant polyethylene fiber, wherein a creep rate of the fiber is $10^{-8}$ s$^{-1}$-$10^{-7}$ s$^{-1}$ under the conditions of a temperature of 70° C. and a load of 300 MPa; a fracture temperature of the fiber is 155° C.-245° C. under the conditions of a load of 15 MPa and a heating rate of 2° C./min, preferably 190° C.-245° C., most preferably 206° C.-245° C.

The mechanism of this invention is as follows:

The photoinitiators designed and developed by the present invention are either photoinitiators I, photoinitiators II with polymer structures, or photoinitiators III with a disubstituted benzophenone structure, and their specific structures endow them with high thermal stability and specific solubility properties (dissolved in the spinning solvent at high temperature while precipitated and retained in the fiber at low temperature, and not be lost with the solvent; insoluble in the extractant and not be dissolved and lost in the extraction process) that conventional small-molecule photoinitiators can not possess. As such, they can be added to the spinning solution, and in the gel spinning, drafting and extraction process, will not volatilize, thermally decompose, dissolve or lose in the extraction process to maintain the stability of properties and quantities; these photoinitiators are present in an amorphous phase of polyethylene after fiber spinning and forming, and finally effectively initiate the cross-linking of amorphous parts of polyethylene fibers under ultraviolet irradiation to achieve the purpose of preparing a polyethylene fiber with high cross-linking degree (high gel content) and high crystallinity.

The polyethylene fiber of the present invention has a double-high structure (high gel content and high crystallinity), which fundamentally restricts the slippage between polyethylene polymer chains in the molecular substrate and aggregation state structure, thereby improving the quality of the fiber in terms of creep resistance, dimensional stability, heat resistance, and so on.

In the present invention, the photoinitiator is directly added to the spinning solution to be reinforced and mixed by the twin-screw at high temperature, which can realize the uniform dispersion of the photoinitiator in the polyethylene solution, the gel fiber, and the drafting fiber, and can avoid the problems of unevenness and overlong time-consuming in the introduction method of forming fiber immersion photoinitiator, and providing the possibility of the continuous preparation of the polyethylene creep-resistant fiber. In addition, the invention adopts the recently developed high-intensity ultraviolet LED light source, and due to the high light intensity, the ultraviolet irradiation cross-linking of polyethylene can be completed within tens of seconds; combined with the high controllability, high stability, long service life, low power consumption and other characteristics of the LED light source, it finally realizes the low cost and stability of continuous preparation of the polyethylene creep-resistant fiber.

Benefits (1) The heat-resistant creep-resistant fiber of the present invention, has a wide range of application, and is suitable for crane ropes, mooring ropes or rigging, and multi-layer composite products for bulletproof applications such as bulletproof vests, helmets, hard and soft protective plates, vehicle armor plates, fishing lines and nets, ground nets, cargo nets and curtains, kite strings, dental floss, tennis racket strings, canvas, woven and nonwoven fabrics, textile tapes, battery separators, capacitors, pressure vessels, hoses, umbilical cables, automotive devices, power transmission belts, cables, fiber-optic cables, construction materials, puncture and cut resistant products, protective gloves, composite sports equipment, skiing skids, helmets, rowboats, canoes, bicycles and boat hulls as well as wing beams, speaker cones, high-performance electronic insulation, radomes, sails, and geotextiles, has comprehensive properties such as wear resistance, heat resistance, creep resistance, impact resistance, self-lubricating, corrosion resistance, low temperature resistance, hygienic and non-toxic, difficult adhesion, difficult water absorption, low density, etc., and is wide in applicability and long in service life;

(2) The method for preparing a heat-resistant creep-resistant polyethylene fiber of the present invention, uses a method for directly adding a photoinitiator with high thermal stability and specific solubility to the spinning solution to solve the problems of uneven initiator distribution and overlong time-consuming in prior arts (introduction method of forming fiber immersion photoinitiator); compared with the traditional ultraviolet light source, the recently developed high-intensity ultraviolet LED light source has a high light intensity, high controllability, high stability, long service life and low power consumption, and the ultraviolet irradiation cross-linking of polyethylene can be stably and continuously completed within tens of seconds; therefore, the method for preparing the polyethylene creep-resistant fiber of the present invention is easy to achieve continuity, low-cost and stabilization, and has wide popularization and application values.

BRIEF DESCRIPTION OF THE DRAWING

FIGURE is a schematic diagram of continuous ultraviolet irradiation cross-linking of polyethylene fibers of the present invention.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

The monomers, thermal initiators, photoinitiators, alkynyl compounds, solvents and so on involved in the examples are purchased from Bide Pharmaceuticals, Sinopharm Group or Tianjin Jiuri New Material Co., Ltd.; antioxidants, pigments, dyes and other auxiliaries are all commercially available products.

Gel content measurement: weighing about 0.2 g of cross-linked fiber in a clean stainless steel mesh to wrap into a small sample package, placing in a Soxhlet extractor, and using xylene to reflux extraction for 6 h. Taking out the sample package and drying in a vacuum drying oven at 80° C. for 12 h, then weighing and calculating the gel content.

Crystallinity measurement: testing the thermal properties of cross-linked polyethylene fibers by using a DSC 8000 type differential scanning calorimeter of Perkin Elmer Company. Weighing 5-8 mg of fiber sample in an aluminum plate, heating from 20° C. to 180° C. at 10° C./min under nitrogen atmosphere. The melt enthalpy of the polyethylene fiber is determined from the heating curve, and then divided by the melt enthalpy of 100% crystalline polyethylene to calculate the degree of crystallinity of the polyethylene fiber.

Creep elongation measurement: performing the tensile creep test method specified in the high-strength chemical fiber filament tensile property test method according to GBT19975-2005, in which the load is 50% of the fiber breaking load, the test temperature of 70° C.

Example 1

A method for preparing a photoinitiator, comprising the following steps:

(1) put azobisisobutyronitrile, xylene, and 4-acryloyloxybenzophenone into a three-necked flask, carry out the polymerization reaction under argon at a temperature of 60° C. and a reaction time of 2 h; wherein the content of azobisisobutyronitrile is 10 wt % of the total mass of 4-acryloyloxybenzophenone; the ratio of the mole number of 4-acryloyloxybenzophenone to the volume of xylene is 1 mol:1 L;

(2) using decompression distillation to remove the unreacted monomer and solvent, and performing vacuum drying at a temperature of 60° C. and a drying time of 12 h to obtain the photoinitiator I; wherein the process condition of decompression distillation is: under the condition of 80° C., gradually reducing the pressure to boiling until the solvent is completely volatilized.

The structural formula of the prepared photoinitiator I is:

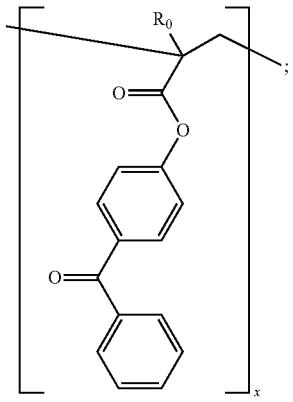

wherein x is an integer, $R_0$ is the hydrogen atom; wherein the number average molecular weight is 1.05 k.

Example 2

A method for preparing a photoinitiator, comprising the following steps:

(1) co-polymerizing azobisisobutyronitrile, xylene, 4-acryloyloxybenzophenone and acrylic acid under argon at a temperature of 65° C. and a reaction time of 3 h; wherein the content of azobisisobutyronitrile is 2 wt % of the total mass of 4-acryloyloxybenzophenone; the mole number of 4-acryloyloxybenzophenone is X and the mole number of acrylic acid is Y, wherein the relationship between X and Y is: X:(X+Y)=0.05; the ratio of the total mole number of 4-acryloyloxybenzophenone and acrylic acid to the volume of xylene is 2 mol:1 L;

(2) using decompression distillation to remove the unreacted monomer and solvent, and performing vacuum drying at a temperature of 60° C. and a drying time of 12 h to obtain the photoinitiator I; wherein the process condition of decompression distillation is: under the condition of 40° C., gradually reducing the pressure to boiling until the solvent is completely volatilized.

The structural formula of the prepared photoinitiator I is:

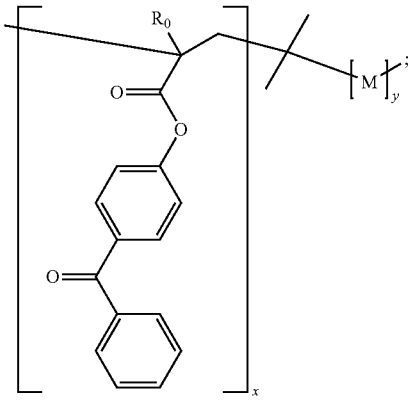

wherein both x and y are integers, $R_0$ is the hydrogen atom; M is the acrylic acid unit; x/(x+y) is 0.05; wherein the number average molecular weight is 15 k.

Example 3

A method for preparing a photoinitiator, comprising the following steps:

(1) co-polymerizing azobisisobutyronitrile, xylene, 4-acryloyloxybenzophenone and styrene under argon at a temperature of 70° C. and a reaction time of 4 h; wherein the content of azobisisobutyronitrile is 0.05 wt % of the total mass of 4-acryloyloxybenzophenone; the mole number of 4-acryloyloxybenzophenone is X and the mole number of styrene is Y, wherein the relationship between X and Y is: X:(X+Y)=0.3; the ratio of the total mole number of 4-acryloyloxybenzophenone and styrene to the volume of xylene is 2 mol:1 L;

(2) using decompression distillation to remove the unreacted monomer and solvent, and performing vacuum drying at a temperature of 60° C. and a drying time of 12 h to obtain the photoinitiator I; wherein the process condition of decompression distillation is: under the condition of 40° C., gradually reducing the pressure to boiling until the solvent is completely volatilized.

The structural formula of the prepared photoinitiator I is:

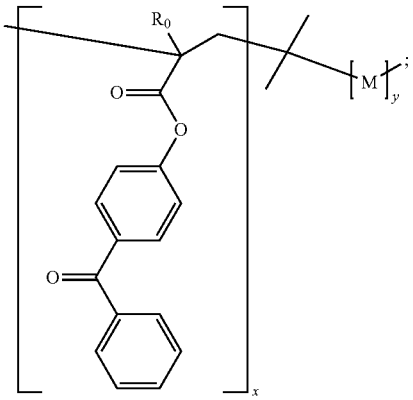

wherein both x and y are integers, $R_0$ is the hydrogen atom; M is the styrene unit; x/(x+y) is 0.3; wherein the number average molecular weight is 100 k.

Example 4

A method for preparing a photoinitiator, comprising the following steps:

(1) co-polymerizing dibenzoyl peroxide, xylene, 4-methacryloyloxybenzophenone and p-chlorostyrene under argon at a temperature of 75° C. and a reaction time of 5 h; wherein the content of dibenzoyl peroxide is 1 wt % of the total mass of 4-methacryloyloxybenzophenone; the mole number of 4-methacryloyloxybenzophenone is X and the mole number of p-chlorostyrene is Y, wherein the relationship between X and Y is: X:(X+Y)=0.5; the ratio of the total mole number of 4-methacryloyloxybenzophenone and p-chlorostyrene to the volume of xylene is 2 mol:1 L;

(2) using precipitation to remove the unreacted monomer and solvent, and performing vacuum drying at a temperature of 60° C. and a drying time of 12 h to obtain the photoinitiator I; wherein the process condition of precipitation is: adding chloroform solvent until the polymer photoinitiator is completely dissolved, then adding ethanol as a precipitant to precipitate the polymer photoinitiator until the precipitate no longer increases, and then filtering to remove the unreacted monomer.

The structural formula of the prepared photoinitiator I is:

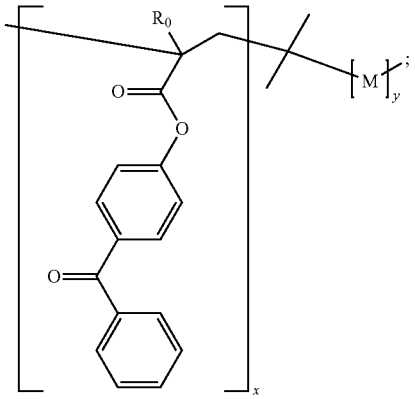

wherein both x and y are integers, $R_0$ is the methyl; M is the p-chlorostyrene unit; x/(x+y) is 0.5; wherein the number average molecular weight is 30 k.

Example 5

A method for preparing a photoinitiator, comprising the following steps:

(1) co-polymerizing dibenzoyl peroxide, xylene, 4-acryloyloxybenzophenone and butyl methacrylate under argon at a temperature of 78° C. and a reaction time of 6 h; wherein the content of dibenzoyl peroxide is 3 wt % of the total mass of 4-acryloyloxybenzophenone; the mole number of 4-acryloyloxybenzophenone is X and the mole number of butyl methacrylate is Y, wherein the relationship between X and Y is: X:(X+Y)=0.5; the ratio of the total mole number of 4-acryloyloxybenzophenone and butyl methacrylate to the volume of xylene is 3 mol:1 L;

(2) using precipitation to remove the unreacted monomer and solvent, and performing vacuum drying at a temperature of 60° C. and a drying time of 12 h to obtain the photoinitiator I; wherein the process condition of precipitation is: adding chloroform solvent until the polymer photoinitiator is completely dissolved, then adding ethanol, methanol or ether as a precipitant to precipitate the polymer photoinitiator until the precipitate no longer increases, and then filtering to remove the unreacted monomer.

The structural formula of the prepared photoinitiator I is:

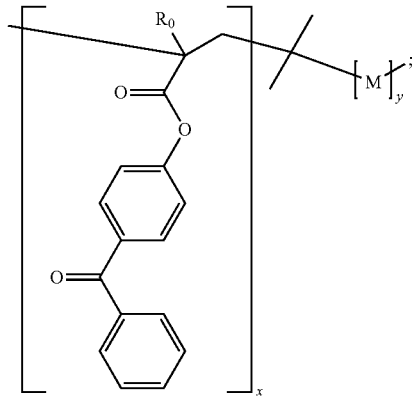

wherein both x and y are integers, $R_0$ is the hydrogen atom; M is the butyl methacrylate; x/(x+y) is 0.5; wherein the number average molecular weight is 15 k.

Example 6

A method for preparing a photoinitiator, comprising the following steps:

(1) co-polymerizing dibenzoyl peroxide, xylene, 4-acryloyloxybenzophenone and behenyl acrylate under argon at a temperature of 80° C. and a reaction time of 8 h; wherein the content of dibenzoyl peroxide is 1 wt % of the total mass of 4-acryloyloxybenzophenone; the mole number of 4-acryloyloxybenzophenone is X and the mole number of behenyl acrylate is Y, wherein the relationship between X and Y is: X:(X+Y)=0.7; the ratio of the total mole number of 4-acryloyloxybenzophenone and behenyl acrylate to the volume of xylene is 3 mol:1 L;

(2) using precipitation to remove the unreacted monomer and solvent, and performing vacuum drying at a temperature of 60° C. and a drying time of 12 h to obtain the photoinitiator I; wherein the process condition of precipitation is: adding chloroform solvent until the polymer photoinitiator is completely dissolved, then adding ether as a precipitant to precipitate the polymer photoinitiator until the precipitate no longer increases, and then filtering to remove the unreacted monomer.

The structural formula of the prepared photoinitiator I is:

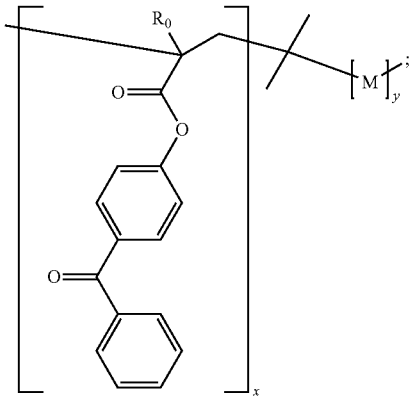

wherein both x and y are integers, $R_0$ is the hydrogen atom; M is the behenyl acrylate; x/(x+y) is 0.7; wherein the number average molecular weight is 28 k.

Example 7

A method for preparing a polymer photoinitiator, comprising the following steps:

Adding 4,4'-dihydroxybenzophenone, dihalogenated hydrocarbon (1,4-dibromobenzene) and inorganic base (sodium carbonate) to the solvent (propanol), and performing polycondensation reaction with solvent reflux under argon, the reaction temperature is 87° C., the reaction time is 16 h, and the stirring speed is 300 rpm; after the reaction, performing suction filtration, alternately and fully washing with water and methanol for four times, and performing vacuum drying at 80° C. for 6 h to obtain the polymer photoinitiator; wherein the molar ratio of 4,4'-dihydroxybenzophenone and dihalogenated hydrocarbon is 0.95:1; the molar ratio of inorganic base and dihalogenated hydrocarbon is 2:1; the ratio of the mole number of 4,4'-dihydroxybenzophenone to the volume of solvent is 3 mol:1 L.

The structural formula of the prepared polymer photoinitiator is:

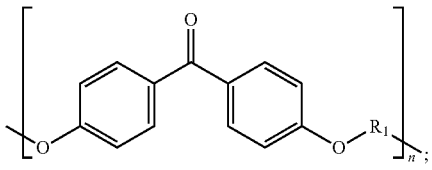

wherein n is an integer; $R_1$ is 1,4-phenylene; the number average molecular weight of the polymer photoinitiator is 1.2 k, the molecular weight distribution is 1.3, and the thermal decomposition temperature is 250° C.

Example 8

A method for preparing a polymer photoinitiator, comprising the following steps:

Adding 4,4'-dihydroxybenzophenone, dihalogenated hydrocarbon (1,20-dibromoeicosane) and inorganic base (sodium bicarbonate) to the solvent (xylene), and performing polycondensation reaction with solvent reflux under nitrogen, the reaction temperature is 140° C., the reaction time is 22 h, and the stirring speed is 300 rpm; after the reaction, performing suction filtration, alternately and fully washing with water and methanol for four times, and performing vacuum drying at 80° C. for 6 h to obtain the polymer photoinitiator; wherein the molar ratio of 4,4'-dihydroxybenzophenone and dihalogenated hydrocarbon is 1:1; the molar ratio of inorganic base and dihalogenated hydrocarbon is 4:1; the ratio of the mole number of 4,4'-dihydroxybenzophenone to the volume of solvent is 1 mol:1 L.

The structural formula of the prepared polymer photoinitiator is:

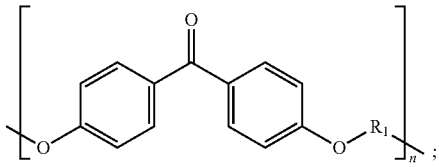

wherein n is an integer; $R_1$ is eicosomethylene; the number average molecular weight of the polymer photoinitiator is 100 k, the molecular weight distribution is 1.54, and the thermal decomposition temperature is 310° C.

Example 9

A method for preparing a polymer photoinitiator, comprising the following steps:

Adding 4,4'-dihydroxybenzophenone, dihalogenated hydrocarbon (dichloromethane) and inorganic base (potassium hydroxide) to the solvent (ethyl acetate), and performing polycondensation reaction with solvent reflux under nitrogen, the reaction temperature is 50° C., the reaction time is 24 h, and the stirring speed is 300 rpm; after the reaction, performing suction filtration, alternately and fully washing with water and methanol for four times, and performing vacuum drying at 80° C. for 6 h to obtain the polymer photoinitiator; wherein the molar ratio of 4,4'-dihydroxybenzophenone and dihalogenated hydrocarbon is 1:1; the molar ratio of inorganic base and dihalogenated hydrocarbon is 2:1; the ratio of the mole number of 4,4'-dihydroxybenzophenone to the volume of solvent is 5 mol:1 L.

The structural formula of the prepared polymer photoinitiator is:

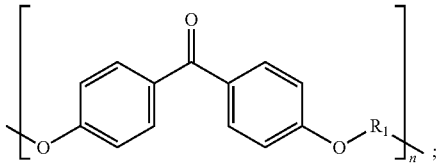

wherein n is an integer; $R_1$ is methylene; the number average molecular weight of the polymer photoinitiator is 12 k, the molecular weight distribution is 1.8, and the thermal decomposition temperature is 295° C.

Example 10

A method for preparing a polymer photoinitiator, comprising the following steps:

(1) acetylation: adding catalyst I (concentrated sulfuric acid) and excess acetic anhydride to 4,4'-dihydroxybenzophenone, heating to acetic anhydride reflux (140° C.) and reacting for 4 h, then cooling to 25° C. and pouring the reaction product into a container filled with a large amount of deionized water, filtering, washing and vacuum drying to obtain 4,4'-acetoxybenzophenone; wherein the molar ratio of 4,4'-dihydroxybenzophenone, catalyst I and acetic anhydride is 1:0.01:2, and the ratio of the mole number of reactants to the volume of deionized water is 1 mol:1 L;

(2) melt polycondensation reaction: adding diacid (malonic acid) and catalyst II (zinc acetate) to 4,4'-acetoxybenzophenone, replacing with nitrogen for 2 times and gradually heating up to 220° C. within 2 h under nitrogen, then polymerizing under the pressure of 290 Pa for 1 h; wherein the molar ratio of 4,4'-acetoxybenzophenone to diacid in the melt polycondensation reaction is 1:1, and the addition amount of catalyst II is 0.2 wt % of the total mass of 4,4'-acetoxybenzophenone and diacid.

The structural formula of the prepared polymer photoinitiator is:

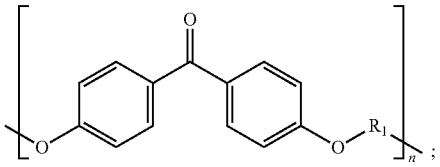

wherein n is an integer; $R_1$

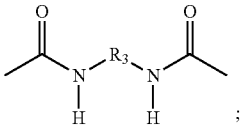

$R_3$ is methylene; the number average molecular weight of the polymer photoinitiator is 1.2 k, the molecular weight distribution is 1.3, and the thermal decomposition temperature is 255° C.

Example 11

A method for preparing a polymer photoinitiator, comprising the following steps:

(1) acetylation: adding catalyst 1 (p-toluenesulfonic acid) and excess acetic anhydride to 4,4'-dihydroxybenzophenone, heating to acetic anhydride reflux (140° C.) and reacting for 3 h, then cooling to 26° C. and pouring the reaction product into a container filled with a large amount of deionized water, filtering, washing and vacuum drying to obtain 4,4'-acetoxybenzophenone; wherein the molar ratio of 4,4'-dihydroxybenzophenone, catalyst I and acetic anhydride is 1:0.05:4, and the ratio of the mole number of reactants to the volume of deionized water is 1 mol:1 L;

(2) melt polycondensation reaction: adding diacid (terephthalic acid) and catalyst II (tetrabutyl titanate) to 4,4'-acetoxybenzophenone, replacing with argon for 3 times and gradually heating up to 230° C. within 1 h under argon, then polymerizing under the pressure of 200 Pa for 5 h; wherein the molar ratio of 4,4'-acetoxybenzophenone to diacid in the melt polycondensation reaction is 1.05:1, and the addition amount of catalyst II is 0.1 wt % of the total mass of 4,4'-acetoxybenzophenone and diacid.

The structural formula of the prepared polymer photoinitiator is:

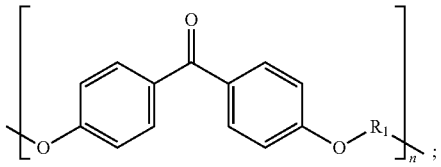

wherein n is an integer; $R_1$

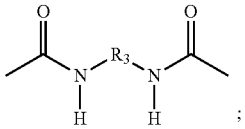

$R_3$ is p-phenylene; the number average molecular weight of the polymer photoinitiator is 5.9 k, the molecular weight distribution is 1.3, and the thermal decomposition temperature is 285° C.

Example 12

A method for preparing a polymer photoinitiator, comprising the following steps:

Adding 4,4'-dihydroxybenzophenone, diisocyanate (diphenylmethane diisocyanate) to the solvent (benzene), and performing reaction with solvent reflux under nitrogen, the reaction temperature is 80° C., the reaction time is 1 h; after the reaction, performing suction filtration, washing with methanol, then performing vacuum drying at 80° C. for 6 h to obtain the polymer photoinitiator; wherein the molar ratio of 4,4'-dihydroxybenzophenone and diisocyanate is 1.05:1; the ratio of the mole number of 4,4'-dihydroxybenzophenone to the volume of solvent is 1 mol:1 L.

The structural formula of the prepared polymer photoinitiator is:

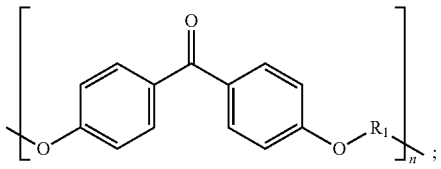

wherein n is an integer; $R_1$ is

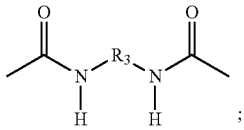

$R_3$ is diphenylmethane; the number average molecular weight of the polymer photoinitiator is 3.7 k, the molecular weight distribution is 1.8, and the thermal decomposition temperature is 262° C.

Example 13

A method for preparing a polymer photoinitiator, comprising the following steps:

Adding 4,4'-dihydroxybenzophenone, diisocyanate (tetramethylene diisocyanate) to the solvent (toluene), and performing reaction with solvent reflux under argon, the reaction temperature is 110° C., the reaction time is 1 h; after the reaction, performing suction filtration, washing with methanol, then performing vacuum drying at 80° C. for 6 h to obtain the polymer photoinitiator; wherein the molar ratio of 4,4'-dihydroxybenzophenone and diisocyanate is 0.95:1; the ratio of the mole number of 4,4'-dihydroxybenzophenone to the volume of solvent is 5 mol:1 L.

The structural formula of the prepared polymer photoinitiator is:

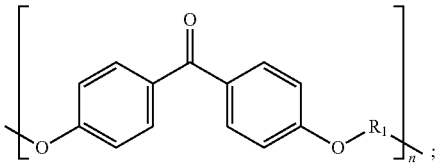

wherein n is an integer; $R_1$ is

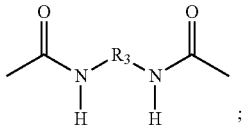

$R_3$ is tetramethylene; the number average molecular weight of the polymer photoinitiator is 1.2 k, the molecular weight distribution is 1.3, and the thermal decomposition temperature is 250° C.

Example 14

A method for preparing a photoinitiator, comprising the following steps:

(1) co-polymerizing dibenzoyl peroxide, xylene, 4-acryloyloxybenzophenone and methacrylic acid under argon at a temperature of 78° C. and a reaction time of 6 h; wherein the content of dibenzoyl peroxide is 3 wt % of the total mass of 4-acryloyloxybenzophenone; the mole number of 4-acryloyloxybenzophenone is X and the mole number of methacrylic acid is Y, wherein the relationship between X and Y is: X:(X+Y)=0.5; the ratio of the total mole number of 4-acryloyloxybenzophenone and methacrylic acid to the volume of xylene is 3 mol:1 L;

(2) using precipitation to remove the unreacted monomer and solvent, and performing vacuum drying at a temperature of 60° C. and a drying time of 12 h to obtain the photoinitiator I; wherein the process condition of precipitation is: adding chloroform solvent until the polymer photoinitiator is completely dissolved, then adding ethanol, methanol or ether as a precipitant to precipitate the polymer photoinitiator until the precipitate no longer increases, and then filtering to remove the unreacted monomer.

The structural formula of the prepared photoinitiator I is:

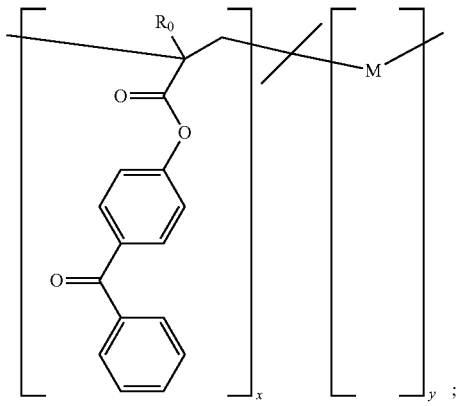

wherein both x and y are integers, $R_0$ is the hydrogen atom; M is methacrylic acid; x/(x+y) is 0.48; wherein the number average molecular weight is 12 k.

Example 15

A method for preparing a heat-resistant creep-resistant polyethylene fiber, as shown in the FIGURE, comprising the following steps:

(1) preparation of polyethylene spinning solution;

adding polyethylene, photoinitiator, alkynyl compound, antioxidant, pigment and dye to the solvent to prepare a polyethylene spinning solution;

wherein the mass ratio of polyethylene to solvent is 30:70; the molecular weight of polyethylene is 300,000;

wherein the solvent is a mixture of n-heptane, n-hexane and cyclohexane, and the mass ratio is 1:1:1;

wherein the content of photoinitiator is 0.2 wt % of the mass of polyethylene; the photoinitiator is the photoinitiator prepared in Example 1;

wherein the alkynyl compound is 1,4-diphenylbutanediyne; the content of alkynyl compound is 5 wt % of the mass of polyethylene;

wherein the antioxidant is vitamin E, the content is 0.1 wt % of the mass of polyethylene;

wherein the pigment is azo pigment, the content is 0.1 wt % of the mass of polyethylene;

wherein the dye is disperse red FB, the content is 0.1 wt % of the mass of polyethylene;

(2) obtaining the polyethylene fiber by dry gel spinning and three-stage drafting the polyethylene spinning solution, the first-stage draft ratio is 2 times; the second-stage draft ratio is 1 time; the third-stage draft ratio is 1 time; the drafting temperature is 90° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 100 mW/cm$^2$, the wavelength of ultraviolet light is 270 nm, and the time of ultraviolet irradiation is 600 s.

The prepared heat-resistant creep-resistant polyethylene fiber has a gel content of 20 wt %, and a crystallinity of 80 wt %; a creep rate of the fiber is $10.0\times10^{-8}$ s$^{-1}$ under the conditions of a temperature of 70° C. and a load of 300 MPa; a fracture temperature of the fiber is 155° C. under the conditions of a load of 15 MPa and a heating rate of 2° C./min.

Example 16

A method for preparing a heat-resistant creep-resistant polyethylene fiber, comprising the following steps:

(1) preparation of polyethylene spinning solution;

adding polyethylene, photoinitiator, alkynyl compound, antioxidant, pigment and dye to the solvent (hydrocarbon solvent) to prepare a polyethylene spinning solution;

wherein the mass ratio of polyethylene to solvent is 20:80; the molecular weight of polyethylene is 1 million;

wherein the content of photoinitiator is 10 wt % of the mass of polyethylene; the photoinitiator is the photoinitiator prepared in Example 2;

wherein the alkynyl compound is 4-phenylalkynylphthalic anhydride; the content of alkynyl compound is 4 wt % of the mass of polyethylene;

wherein the antioxidant is butylated hydroxytoluene, the content is 0.25 wt % of the mass of polyethylene;

wherein the pigment is phthalocyanine pigment, the content is 0.2 wt % of the mass of polyethylene;

wherein the dye is disperse orange S-4RL, the content is 0.25 wt % of the mass of polyethylene;

(2) obtaining the polyethylene fiber by dry gel spinning and three-stage drafting the polyethylene spinning solution; the first-stage draft ratio is 3 times; the second-stage draft ratio is 1 time; the third-stage draft ratio is 1 time; the drafting temperature is 95° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 1000 mW/cm$^2$, the wavelength of ultraviolet light is 365 nm, and the time of ultraviolet irradiation is 60 s.

The prepared heat-resistant creep-resistant polyethylene fiber has a gel content of 100 wt %, and a crystallinity of 50 wt %; a creep rate of the fiber is $1.4\times10^{4}$ s$^{-1}$ under the conditions of a temperature of 70° C. and a load of 300 MPa; a fracture temperature of the fiber is 241° C. under the conditions of a load of 15 MPa and a heating rate of 2° C./min.

Example 17

A method for preparing a heat-resistant creep-resistant polyethylene fiber, comprising the following steps:

(1) preparation of polyethylene spinning solution;

adding polyethylene, photoinitiator, alkynyl compound, antioxidant, pigment and dye to the solvent (tetrahydronaphthalene) to prepare a polyethylene spinning solution;

wherein the mass ratio of polyethylene to solvent is 15:85; the molecular weight of polyethylene is 2.8 million;

wherein the content of photoinitiator is 0.8 wt % of the mass of polyethylene; the photoinitiator is the photoinitiator prepared in Example 3;

wherein the alkynyl compound is 4,4'-diethynylbiphenyl; the content of alkynyl compound is 2 wt % of the mass of polyethylene;

wherein the antioxidant is bis(2,4-di-tert-butylphenol) pentaerythritol diphosphite, the content is 0.5 wt % of the mass of polyethylene;

wherein the pigment is anthraquinone, the content is 0.2 wt % of the mass of polyethylene;

wherein the dye is disperse violet HFRL, the content is 0.5 wt % of the mass of polyethylene;

(2) obtaining the polyethylene fiber by dry gel spinning and three-stage drafting the polyethylene spinning solution; the first-stage draft ratio is 4 times; the second-stage draft ratio is 2 times; the third-stage draft ratio is 2 times; the drafting temperature is 100° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 800 mW/cm$^2$, the wavelength of ultraviolet light is 365 nm, and the time of ultraviolet irradiation is 90 s.

The prepared heat-resistant creep-resistant polyethylene fiber has a gel content of 95 wt %, and a crystallinity of 85 wt %; a creep rate of the fiber is $1.5\times10^{-8}$ s$^{-1}$ under the conditions of a temperature of 70° C. and a load of 300 MPa; a fracture temperature of the fiber is 240° C. under the conditions of a load of 15 MPa and a heating rate of 2° C./min.

Example 18

A method for preparing a heat-resistant creep-resistant polyethylene fiber, comprising the following steps:

(1) preparation of polyethylene spinning solution;

adding polyethylene, photoinitiator, alkynyl compound, antioxidant, pigment and dye to the solvent (decahydronaphthalene) to prepare a polyethylene spinning solution;

wherein the mass ratio of polyethylene to solvent is 10:90; the molecular weight of polyethylene is 4 million;

wherein the content of photoinitiator is 4 wt % of the mass of polyethylene; the photoinitiator is the photoinitiator prepared in Example 4;

wherein the alkynyl compound is 1,3,5-triynylbenzene; the content of alkynyl compound is 2 wt % of the mass of polyethylene;

wherein the antioxidant is tris(2,4-di-tert-butylphenyl) phosphite, the content is 0.5 wt % of the mass of polyethylene;

wherein the pigment is anthraquinone, the content is 0.2 wt % of the mass of polyethylene;

wherein the dye is disperse blue CR-E, the content is 0.1 wt % of the mass of polyethylene;

(2) obtaining the polyethylene fiber by dry gel spinning and three-stage drafting the polyethylene spinning solution; the first-stage draft ratio is 5 times; the second-stage draft ratio is 2 times; the third-stage draft ratio is 2 times; the drafting temperature is 105° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 500 mW/cm$^2$, the wavelength of ultraviolet light is 360 nm, and the time of ultraviolet irradiation is 120 s.

The prepared heat-resistant creep-resistant polyethylene fiber has a gel content of 93 wt %, and a crystallinity of 70 wt %; a creep rate of the fiber is $1.9\times10^{-8}$ s$^{-1}$ under the conditions of a temperature of 70° C. and a load of 300 MPa; a fracture temperature of the fiber is 236° C. under the conditions of a load of 15 MPa and a heating rate of 2° C./min.

Example 19

A method for preparing a heat-resistant creep-resistant polyethylene fiber, comprising the following steps:

(1) preparation of polyethylene spinning solution;

adding polyethylene, photoinitiator, alkynyl compound, and antioxidant to the solvent (decahydronaphthalene) to prepare a polyethylene spinning solution;

wherein the mass ratio of polyethylene to solvent is 10:90; the molecular weight of polyethylene is 4 million;

wherein the content of photoinitiator is 3 wt % of the mass of polyethylene; the photoinitiator is the photoinitiator prepared in Example 5;

wherein the alkynyl compound is 1,3-dialkynylbenzene; the content of alkynyl compound is 2 wt % of the mass of polyethylene;

wherein the antioxidant is vitamin E, the content is 0.5 wt % of the mass of polyethylene;

(2) obtaining the polyethylene fiber by dry gel spinning and three-stage drafting the polyethylene spinning solution; the first-stage draft ratio is 6 times; the second-stage draft ratio is 1 time; the third-stage draft ratio is 1 time; the drafting temperature is 130° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 1500 mW/cm$^2$, the wavelength of ultraviolet light is 365 nm, and the time of ultraviolet irradiation is 60 s.

The prepared heat-resistant creep-resistant polyethylene fiber has a gel content of 100 wt %, and a crystallinity of 80 wt %; a creep rate of the fiber is $1.0\times10^{-8}$ s$^{-1}$ under the conditions of a temperature of 70° C. and a load of 300 MPa; a fracture temperature of the fiber is 245° C. under the conditions of a load of 15 MPa and a heating rate of 2° C./min.

Example 20

A method for preparing a heat-resistant creep-resistant polyethylene fiber, comprising the following steps:

(1) preparation of polyethylene spinning solution;

adding polyethylene, photoinitiator, alkynyl compound, and antioxidant to the solvent (decahydronaphthalene) to prepare a polyethylene spinning solution;

wherein the mass ratio of polyethylene to solvent is 10:90; the molecular weight of polyethylene is 5 million;

wherein the content of photoinitiator is 5 wt % of the mass of polyethylene; the photoinitiator is the photoinitiator prepared in Example 6;

wherein the alkynyl compound is 1,4-dialkynylbenzene; the content of alkynyl compound is 0.1 wt % of the mass of polyethylene;

wherein the antioxidant is vitamin E, the content is 0.5 wt % of the mass of polyethylene;

(2) obtaining the polyethylene fiber by dry gel spinning and three-stage drafting the polyethylene spinning solution; the first-stage draft ratio is 7 times; the second-stage draft ratio is 1 time; the third-stage draft ratio is 1 time; the drafting temperature is 125° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 1800 mW/cm$^2$, the wavelength of ultraviolet light is 290 nm, and the time of ultraviolet irradiation is 40 s.

The prepared heat-resistant creep-resistant polyethylene fiber has a gel content of 63 wt %, and a crystallinity of 65 wt %; a creep rate of the fiber is $5.4\times10^{-8}$ s$^{-1}$ under the conditions of a temperature of 70° C. and a load of 300 MPa; a fracture temperature of the fiber is 202° C. under the conditions of a load of 15 MPa and a heating rate of 2° C./min.

Example 21

A method for preparing a heat-resistant creep-resistant polyethylene fiber, comprising the following steps:

(1) preparation of polyethylene spinning solution;

adding polyethylene, photoinitiator, and antioxidant to the solvent (white oil) to prepare a polyethylene spinning solution;

wherein the mass ratio of polyethylene to solvent is 10:90; the molecular weight of polyethylene is 5 million;

wherein the content of photoinitiator is 1 wt % of the mass of polyethylene; the photoinitiator is the photoinitiator prepared in Example 7;

wherein the antioxidant is vitamin E, the content is 0.5 wt % of the mass of polyethylene;

(2) obtaining the polyethylene fiber by wet gel spinning and three-stage drafting the polyethylene spinning solution; the first-stage draft ratio is 8 times; the second-stage draft ratio is 2 times; the third-stage draft ratio is 2 times; the drafting temperature is 120° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 1600 mW/cm$^2$, the wavelength of ultraviolet light is 330 nm, and the time of ultraviolet irradiation is 120 s.

The prepared heat-resistant creep-resistant polyethylene fiber has a gel content of 91 wt %, and a crystallinity of 75 wt %; a creep rate of the fiber is $2.1\times10^{-8}$ s$^{-1}$ under the conditions of a temperature of 70° C. and a load of 300 MPa; a fracture temperature of the fiber is 234° C. under the conditions of a load of 15 MPa and a heating rate of 2° C./min.

Example 22

A method for preparing a heat-resistant creep-resistant polyethylene fiber, comprising the following steps:

(1) preparation of polyethylene spinning solution;

adding polyethylene and photoinitiator to the solvent (mineral oil) to prepare a polyethylene spinning solution;

wherein the mass ratio of polyethylene to solvent is 10:90; the molecular weight of polyethylene is 5 million;

wherein the content of photoinitiator is 5 wt % of the mass of polyethylene; the photoinitiator is the photoinitiator prepared in Example 8;

(2) obtaining the polyethylene fiber by wet gel spinning and three-stage drafting the polyethylene spinning solution; the first-stage draft ratio is 2 times; the second-stage draft ratio is 2 times; the third-stage draft ratio is 2 times; the drafting temperature is 110° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 2300 mW/cm$^2$, the wavelength of ultraviolet light is 340 nm, and the time of ultraviolet irradiation is 180 s.

The prepared heat-resistant creep-resistant polyethylene fiber has a gel content of 95 wt %, and a crystallinity of 85 wt %; a creep rate of the fiber is $1.5\times10^{-8}$ s$^{-1}$ under the conditions of a temperature of 70° C. and a load of 300 MPa; a fracture temperature of the fiber is 240° C. under the conditions of a load of 15 MPa and a heating rate of 2° C./min.

Example 23

A method for preparing a heat-resistant creep-resistant polyethylene fiber, comprising the following steps:

(1) preparation of polyethylene spinning solution;

adding polyethylene, photoinitiator, and antioxidant to the solvent (vegetable oil) to prepare a polyethylene spinning solution;

wherein the mass ratio of polyethylene to solvent is 10:90; the molecular weight of polyethylene is 5 million;

wherein the content of photoinitiator is 3 wt % of the mass of polyethylene; the photoinitiator is the photoinitiator prepared in Example 9;

wherein the antioxidant is butylated hydroxytoluene, the content is 0.5 wt % of the mass of polyethylene;

(2) obtaining the polyethylene fiber by wet gel spinning and three-stage drafting the polyethylene spinning solution; the first-stage draft ratio is 3 times; the second-stage draft ratio is 1 time; the third-stage draft ratio is 1 time; the drafting temperature is 130° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 2900 mW/cm$^2$, the wavelength of ultraviolet light is 350 nm, and the time of ultraviolet irradiation is 30 s.

The prepared heat-resistant creep-resistant polyethylene fiber has a gel content of 89 wt %, and a crystallinity of 87 wt %; a creep rate of the fiber is $2.2\times10^{-8}$ s$^{-1}$ under the conditions of a temperature of 70° C. and a load of 300 MPa; a fracture temperature of the fiber is 234° C. under the conditions of a load of 15 MPa and a heating rate of 2° C./min.

Example 24

A method for preparing a heat-resistant creep-resistant polyethylene fiber, comprising the following steps:

(1) preparation of polyethylene spinning solution;

adding polyethylene, photoinitiator, antioxidant, and pigment to the solvent (animal oil) to prepare a polyethylene spinning solution;

wherein the mass ratio of polyethylene to solvent is 10:90; the molecular weight of polyethylene is 5 million;

wherein the content of photoinitiator is 3 wt % of the mass of polyethylene; the photoinitiator is the photoinitiator prepared in Example 10;

wherein the antioxidant is butylated hydroxytoluene, the content is 0.5 wt % of the mass of polyethylene;

wherein the pigment is anthraquinone, the content is 0.1 wt % of the mass of polyethylene;

(2) obtaining the polyethylene fiber by wet gel spinning and three-stage drafting the polyethylene spinning solution; the first-stage draft ratio is 4 times; the second-stage draft ratio is 1 time; the third-stage draft ratio is 1 time; the drafting temperature is 135° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 3400 mW/cm$^2$, the wavelength of ultraviolet light is 370 nm, and the time of ultraviolet irradiation is 40 s.

The prepared heat-resistant creep-resistant polyethylene fiber has a gel content of 91 wt %, and a crystallinity of 83 wt %; a creep rate of the fiber is $2.0\times10^{-8}$ s$^{-1}$ under the conditions of a temperature of 70° C. and a load of 300 MPa; a fracture temperature of the fiber is 235° C. under the conditions of a load of 15 MPa and a heating rate of 2° C./min.

Example 25

A method for preparing a heat-resistant creep-resistant polyethylene fiber, comprising the following steps:

(1) preparation of polyethylene spinning solution;

adding polyethylene, photoinitiator, and antioxidant to the solvent (kerosene) to prepare a polyethylene spinning solution;

wherein the mass ratio of polyethylene to solvent is 10:90; the molecular weight of polyethylene is 2 million;

wherein the content of photoinitiator is 3 wt % of the mass of polyethylene; the photoinitiator is the photoinitiator prepared in Example 11;

wherein the antioxidant is butylated hydroxytoluene, the content is 0.5 wt % of the mass of polyethylene;

(2) obtaining the polyethylene fiber by wet gel spinning and three-stage drafting the polyethylene spinning solution; the first-stage draft ratio is 5 times; the second-stage draft ratio is 2 times; the third-stage draft ratio is 2 times; the drafting temperature is 140° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 3700 mW/cm$^2$, the wavelength of ultraviolet light is 365 nm, and the time of ultraviolet irradiation is 20 s.

The prepared heat-resistant creep-resistant polyethylene fiber has a gel content of 68 wt %, and a crystallinity of 81 wt %; a creep rate of the fiber is $4.6\times10^{-8}$ s$^{-1}$ under the conditions of a temperature of 70° C. and a load of 300 MPa; a fracture temperature of the fiber is 209° C. under the conditions of a load of 15 MPa and a heating rate of 2° C./min.

Example 26

A method for preparing a heat-resistant creep-resistant polyethylene fiber, comprising the following steps:

(1) preparation of polyethylene spinning solution;

adding polyethylene, photoinitiator, and pigment to the solvent (white oil) to prepare a polyethylene spinning solution;

wherein the mass ratio of polyethylene to solvent is 10:90; the molecular weight of polyethylene is 4 million;

wherein the content of photoinitiator is 3 wt % of the mass of polyethylene; the photoinitiator is the photoinitiator prepared in Example 12;

wherein the pigment is anthraquinone, the content is 0.1 wt % of the mass of polyethylene;

(2) obtaining the polyethylene fiber by wet gel spinning and three-stage drafting the polyethylene spinning solution; the first-stage draft ratio is 6 times; the second-stage draft ratio is 2 times; the third-stage draft ratio is 2 times; the drafting temperature is 127° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 4500 mW/cm$^2$, the wavelength of ultraviolet light is 365 nm, and the time of ultraviolet irradiation is 10 s.

The prepared heat-resistant creep-resistant polyethylene fiber has a gel content of 78 wt %, and a crystallinity of 82 wt %; a creep rate of the fiber is $3.5\times10^{-8}$ s$^{-1}$ under the conditions of a temperature of 70° C. and a load of 300 MPa; a fracture temperature of the fiber is 221° C. under the conditions of a load of 15 MPa and a heating rate of 2° C./min.

Example 27

A method for preparing a heat-resistant creep-resistant polyethylene fiber, comprising the following steps:

(1) preparation of polyethylene spinning solution;

adding polyethylene and photoinitiator to the solvent (xylene) to prepare a polyethylene spinning solution;

wherein the mass ratio of polyethylene to solvent is 5:95; the molecular weight of polyethylene is 6 million;

wherein the content of photoinitiator is 3 wt % of the mass of polyethylene; the photoinitiator is the photoinitiator prepared in Example 13;

(2) obtaining the polyethylene fiber by dry gel spinning and three-stage drafting the polyethylene spinning solution; the first-stage draft ratio is 7 times; the second-stage draft ratio is 1 time; the third-stage draft ratio is 1 time; the drafting temperature is 134° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 3000 mW/cm$^2$, the wavelength of ultraviolet light is 395 nm, and the time of ultraviolet irradiation is 120 s.

The prepared heat-resistant creep-resistant polyethylene fiber has a gel content of 26 wt %, and a crystallinity of 86 wt %; a creep rate of the fiber is $9.3\times10^{-8}$ s$^{-1}$ under the conditions of a temperature of 70° C. and a load of 300 MPa; a fracture temperature of the fiber is 163° C. under the conditions of a load of 15 MPa and a heating rate of 2° C./min.

Example 28

A method for preparing a heat-resistant creep-resistant polyethylene fiber, comprising the following steps:

(1) preparation of polyethylene spinning solution;

adding polyethylene, photoinitiator, alkynyl compound, and antioxidant to the solvent to prepare a polyethylene spinning solution;

wherein the mass ratio of polyethylene to solvent is 5:95; the molecular weight of polyethylene is 10 million;

wherein the solvent is a mixture of tetrahydronaphthalene and decahydronaphthalene, and the mass ratio is 1:1;

wherein the content of photoinitiator is 3 wt % of the mass of polyethylene; the photoinitiators are the photoinitiators prepared in Example 6 and Example 11, and the mass ratio is 1:1;

wherein the alkynyl compound is a mixture of 1,4-diphenylbutanediyne and 4-phenylalkynylphthalic anhydride, and the mass ratio is 1:1; the content of alkynyl compound is 2 wt % of the mass of polyethylene;

wherein the antioxidant is butylated hydroxytoluene, the content is 0.5 wt % of the mass of polyethylene;

(2) obtaining the polyethylene fiber by dry gel spinning and three-stage drafting the polyethylene spinning solution; the first-stage draft ratio is 8 times; the second-stage draft ratio is 1 time; the third-stage draft ratio is 1 time; the drafting temperature is 145° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 5000 mW/cm$^2$, the wavelength of ultraviolet light is 400 nm, and the time of ultraviolet irradiation is 120 s.

The prepared heat-resistant creep-resistant polyethylene fiber has a gel content of 31 wt %, and a crystallinity of 90 wt %; a creep rate of the fiber is $8.6\times10^{-8}$ s$^{-1}$ under the conditions of a temperature of 70° C. and a load of 300 MPa; a fracture temperature of the fiber is 169° C. under the conditions of a load of 15 MPa and a heating rate of 2° C./min.

Example 29

A method for preparing a heat-resistant creep-resistant polyethylene fiber, comprising the following steps:

(1) preparation of polyethylene spinning solution;

adding polyethylene, photoinitiator, and antioxidant to the solvent (decahydronaphthalene) to prepare a polyethylene spinning solution;

wherein the mass ratio of polyethylene to solvent is 10:90; the molecular weight of polyethylene is 4 million;

wherein the content of photoinitiator is 3 wt % of the mass of polyethylene; the photoinitiator is the photoinitiator prepared in Example 5;

wherein the antioxidant is vitamin E, the content is 0.5 wt % of the mass of polyethylene;

(2) obtaining the polyethylene fiber by dry gel spinning and three-stage drafting the polyethylene spinning solution; the first-stage draft ratio is 2 times; the second-stage draft ratio is 2 times; the third-stage draft ratio is 2 times; the drafting temperature is 150° C.;

(3) performing ultraviolet irradiation on the polyethylene fiber obtained in step (2) by an ultraviolet light source to obtain the heat-resistant creep-resistant polyethylene fiber; wherein the light intensity of the ultraviolet light source is 1500 mW/cm$^2$, the wavelength of ultraviolet light is 365 nm, and the time of ultraviolet irradiation is 60 s.

The prepared heat-resistant creep-resistant polyethylene fiber has a gel content of 70 wt %, and a crystallinity of 80 wt %; a creep rate of the fiber is $4.4\times10^{-8}$ s$^{-1}$ under the conditions of a temperature of 70° C. and a load of 300 MPa; a fracture temperature of the fiber is 211° C. under the conditions of a load of 15 MPa and a heating rate of 2° C./min.

Comparison 1

A method for preparing a heat-resistant creep-resistant polyethylene fiber, basically is the same as Example 29, except that the photoinitiator is not added in step (1).

The prepared heat-resistant creep-resistant polyethylene fiber has a gel content of 0 wt %, and a crystallinity of 80 wt %; a creep rate of the fiber is $3\times10^{-6}$ s$^{-1}$ under the conditions of a temperature of 70° C. and a load of 300 MPa; a fracture temperature of the fiber is 145° C. under the conditions of a load of 15 MPa and a heating rate of 2° C./min.

Comparing Comparison 1 with Example 29, the gel content of Comparison 1 is much lower than that of Example 29, the crystallinity is equivalent to that of Example 29, the creep rate is much higher than that of Example 29, and the fracture temperature of the fiber is much lower than that of Example 29, because in Example 29, the photoinitiator initiates polyethylene crosslinking under ultraviolet irradiation to form a three-dimensional network structure, which structurally inhibits the mutual slippage between polymer chains, thereby fundamentally improving the heat resistance and creep resistance performances of the polyethylene fiber.

Example 30

A method for preparing a heat-resistant creep-resistant polyethylene fiber, basically is the same as Example 29, except that the photoinitiator is 4,4'-dichlorobenzophenone.

The prepared heat-resistant creep-resistant polyethylene fiber has a gel content of 72 wt %, and a crystallinity of 80 wt %; a creep rate of the fiber is $4.4\times10^{-8}$ s$^{-1}$ under the conditions of a temperature of 70° C. and a load of 300 MPa; a fracture temperature of the fiber is 188° C. under the conditions of a load of 15 MPa and a heating rate of 2° C./min.

Example 31

A method for preparing a heat-resistant creep-resistant polyethylene fiber, basically is the same as Example 29, except that the photoinitiator is 2,4'-dimethoxybenzophenone.

The prepared heat-resistant creep-resistant polyethylene fiber has a gel content of 75 wt %, and a crystallinity of 75 wt %; a creep rate of the fiber is $3.9\times10^{-8}$ s$^{-1}$ under the conditions of a temperature of 70° C. and a load of 300 MPa; a fracture temperature of the fiber is 193° C. under the conditions of a load of 15 MPa and a heating rate of 2° C./min.

Example 32

A method for preparing a heat-resistant creep-resistant polyethylene fiber, basically is the same as Example 29, except that the photoinitiator is 4,4'-dimethylbenzophenone.

The prepared heat-resistant creep-resistant polyethylene fiber has a gel content of 65 wt %, and a crystallinity of 83 wt %: a creep rate of the fiber is $6\times10^{-8}$ s$^{-1}$ under the conditions of a temperature of 70° C. and a load of 300 MPa; a fracture temperature of the fiber is 172° C. under the conditions of a load of 15 MPa and a heating rate of 2° C./min.

Example 33

A method for preparing a heat-resistant creep-resistant polyethylene fiber, basically is the same as Example 29, except that the photoinitiator is 4,4'-diphenoxybenzophenone.

The prepared heat-resistant creep-resistant polyethylene fiber has a gel content of 80 wt %, and a crystallinity of 70 wt %; a creep rate of the fiber is $3.4\times10^{-8}$ s$^{-1}$ under the conditions of a temperature of 70° C. and a load of 300 MPa; a fracture temperature of the fiber is 197° C. under the conditions of a load of 15 MPa and a heating rate of 2° C./min.

Example 34

A method for preparing a heat-resistant creep-resistant polyethylene fiber, basically is the same as Example 29, except that the photoinitiator is 4,4'-dihydroxybenzophenone.

The prepared heat-resistant creep-resistant polyethylene fiber has a gel content of 78 wt %, and a crystallinity of 72 wt %; a creep rate of the fiber is $3.6\times10^{-8}$ s$^{-1}$ under the conditions of a temperature of 70° C. and a load of 300 MPa; a fracture temperature of the fiber is 195° C. under the conditions of a load of 15 MPa and a heating rate of 2° C./min.

Example 35

A method for preparing a heat-resistant creep-resistant polyethylene fiber, basically is the same as Example 29, except that the photoinitiator is 4-chloro-4'-hydroxybenzophenone.

The prepared heat-resistant creep-resistant polyethylene fiber has a gel content of 77 wt %, and a crystallinity of 78 wt %; a creep rate of the fiber is $3.6\times10^{-8}$ s$^{-1}$ under the conditions of a temperature of 70° C. and a load of 300 MPa; a fracture temperature of the fiber is 195° C. under the conditions of a load of 15 MPa and a heating rate of 2° C./min.

Example 36

A method for preparing a heat-resistant creep-resistant polyethylene fiber, basically is the same as Example 29, except that the photoinitiator is the photoinitiator prepared in Example 14.

The prepared heat-resistant creep-resistant polyethylene fiber has a gel content of 72 wt %, and a crystallinity of 81 wt %; a creep rate of the fiber is $6.3\times10^{-8}$ s$^{-1}$ under the conditions of a temperature of 70° C. and a load of 300 MPa; a fracture temperature of the fiber is 207° C. under the conditions of a load of 15 MPa and a heating rate of 2° C./min.

What is claimed is:

1. A polyethylene spinning solution, comprising a polyethylene, a solvent, and a photoinitiator, wherein a content of the photoinitiator is 0.2 wt %-10 wt % of a mass of the polyethylene;

the photoinitiator is one or more selected from the group consisting of a first photoinitiator and a second photoinitiator, wherein the photoinitiator comprises the first photoinitiator;

a structural formula of the first photoinitiator is

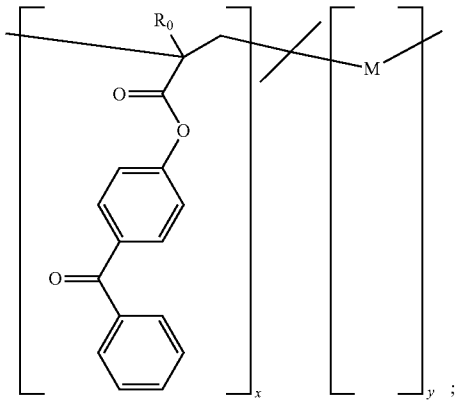

wherein $R_0$ is a hydrogen atom, hydrocarbyl of C1-C10, or halogen; M is a styrene unit, an acrylic acid unit, a methacrylic acid unit, a styrene derivative unit, an acrylic acid derivative unit, or a methacrylic acid derivative unit; a value of x is an integer of 2-1000, and a value of y is an integer of 0-2000; wherein, in the first photoinitiator, $R_0$ is a hydrogen atom, M is a butyl methacrylate unit, x/(x+y) is 0.5, and a number average molecular weight of the first photoinitiator is 15k;

a structural formula of the second photoinitiator is

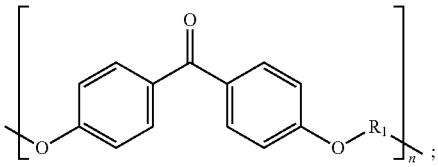

wherein n is an integer greater than or equal to 2; $R_1$ is alkylene of C1-C20 or

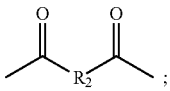

$R_2$ is alkylene of C1-C18; and wherein the polyethylene spinning solution further comprises an alkynyl compound; in the polyethylene spinning solution, a content of the alkynyl compound is 0.1 wt %-5.0 wt % of the mass of the polyethylene; the alkynyl compound is one or more selected from the group consisting of 1,4-diphenylbutanediyne, 4-phenylalkynylphthalic anhydride, 4,4'-diethynylbiphenyl, 1,3,5-triynylbenzene, 1,3-dialkynylbenzene, and 1,4-dialkynylbenzene

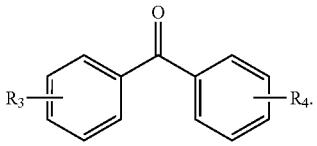

2. The polyethylene spinning solution of claim 1, wherein a number average molecular weight of the first photoinitiator is 1.05k-100k, $R_0$ is the hydrogen atom or methyl, x/(x+y) is 0.05-1; and in the structural formula of the second photoinitiator, wherein the alkylene is saturated alkylene or arylene; a number average molecular weight of the second photoinitiator is 1.2k-100k, and a molecular weight distribution is 1.3-1.8.

3. The polyethylene spinning solution of claim 1, wherein in the polyethylene spinning solution, a mass ratio of the polyethylene to the solvent is (5:95)-(30:70), and the solvent is one or more selected from the group consisting of tetrahydronaphthalene, decahydronaphthalene, n-heptane, n-hexane, cyclohexane, a paraffin oil, a white oil, a mineral oil, a vegetable oil, an animal oil, kerosene, a hydrocarbon solvent, and a xylene solvent.

4. The polyethylene spinning solution of claim 1, wherein the polyethylene spinning solution further comprises an antioxidant, a pigment, and/or a dye.

5. A method for preparing a heat-resistant creep-resistant polyethylene fiber by the polyethylene spinning solution according to claim 1, comprising the following steps:

(1) gel-spinning and multi-stage drafting the polyethylene spinning solution to obtain a polyethylene fiber;

(2) performing an ultraviolet irradiation on the polyethylene fiber obtained in step (1) by an ultraviolet light source to obtain the heat-resistant creep-resistant polyethylene fiber; wherein a light intensity of the ultraviolet light source is 100 $W/cm^2$-5000 $W/cm^2$, and a time of the ultraviolet irradiation is 10s-600s.

6. The method of claim 5, wherein the multi-stage drafting in step (1) is a three-stage draft: a first-stage draft ratio is 2-8 times; a second-stage draft ratio is 1-2 times; a third-stage draft ratio is 1-2 times; a drafting temperature is 90-150° C.

7. The method of claim 5, wherein a wavelength of the ultraviolet light source in step (2) is 270 nm-400 nm.

8. A heat-resistant creep-resistant polyethylene fiber prepared by the method according to claim 6, wherein the heat-resistant creep-resistant polyethylene fiber has a gel content of 20 wt %-100 wt % and a crystallinity of 50 wt %-90 wt %.

9. The heat-resistant creep-resistant polyethylene fiber of claim 8, wherein a creep rate of the heat-resistant creep-resistant polyethylene fiber is $10^{-8}$ $s^{-1}$-$10^{-7}$ $s^{-1}$ under conditions of a temperature of 70° C. and a load of 300 MPa; a fracture temperature of the heat-resistant creep-resistant polyethylene fiber is 155° C.-245° C. under conditions of a load of 15 MPa and a heating rate of 2° C./min.

10. The method of claim 5, wherein in the polyethylene spinning solution, a number average molecular weight of the first photoinitiator is 1.05k-100k, $R_0$ is the hydrogen atom or methyl, x/(x+y) is 0.05-1; and in the structural formula of the second photoinitiator, wherein the alkylene is saturated alkylene or arylene; a number average molecular weight of the second photoinitiator is 1.2k-100k, and a molecular weight distribution is 1.3-1.8.

11. The method of claim 5, wherein in the polyethylene spinning solution, a mass ratio of the polyethylene to the solvent is (5:95)-(30:70), and the solvent is one or more selected from the group consisting of tetrahydronaphthalene, decahydronaphthalene, n-heptane, n-hexane, cyclohexane, a paraffin oil, a white oil, a mineral oil, a vegetable oil, an animal oil, kerosene, a hydrocarbon solvent, and a xylene solvent.

12. The method of claim 5, wherein the polyethylene spinning solution further comprises an alkynyl compound; in the polyethylene spinning solution, a content of the alkynyl compound is 0.1 wt %-5.0 wt % of the mass of the polyethylene; the alkynyl compound is one or more selected from the group consisting of 1,4-diphenylbutanediyne, 4-phenylalkynylphthalic anhydride, 4,4'-diethynylbiphenyl, 1,3,5-triynylbenzene, 1,3-dialkynylbenzene, and 1,4-dialkynylbenzene.

13. The method of claim 5, wherein the polyethylene spinning solution further comprises an antioxidant, a pigment, and/or a dye.

14. The heat-resistant creep-resistant polyethylene fiber of claim 8, wherein in the method for preparing the heat-resistant creep-resistant polyethylene fiber, the multi-stage drafting in step (1) is a three-stage draft: a first-stage draft ratio is 2-8 times; a second-stage draft ratio is 1-2 times; a third-stage draft ratio is 1-2 times; a drafting temperature is 90-150° C.

15. The heat-resistant creep-resistant polyethylene fiber of claim 8, wherein in the method for preparing the heat-resistant creep-resistant polyethylene fiber, a wavelength of the ultraviolet light source in step (2) is 270 nm-400 nm.

* * * * *